US006347568B1

(12) United States Patent
Soulaigre

(10) Patent No.: US 6,347,568 B1
(45) Date of Patent: Feb. 19, 2002

(54) GUIDE SYSTEM FOR THE RECOILING MASS OF A GUN

(75) Inventor: Gérard Soulaigre, La Chappelle (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 09/626,147

(22) Filed: Jul. 26, 2000

(30) Foreign Application Priority Data

Jul. 26, 1999 (FR) ..... 99 09665

(51) Int. Cl.[7] ..... F41A 25/00
(52) U.S. Cl. ..... 89/42.01
(58) Field of Search ..... 89/42.01, 44.01, 89/43.01

(56) References Cited

U.S. PATENT DOCUMENTS

| | | | | | |
|---|---|---|---|---|---|
| 955,795 | A | * | 4/1910 | Haussner | 89/42.03 |
| 1,288,372 | A | * | 12/1918 | Bell | 89/44.01 |
| 2,273,878 | A | * | 2/1942 | Magrum et al. | 89/42.01 |
| 2,333,398 | A | * | 11/1943 | Trotter et al. | 89/42.01 |
| 2,433,637 | A | * | 12/1947 | Trotter | 89/42.01 |
| 3,500,718 | A | * | 3/1970 | Stoner | 89/138 |
| 4,269,109 | A | * | 5/1981 | Stoner | 89/198 |
| 5,339,789 | A | * | 8/1994 | Heitz | 124/56 |
| 5,703,318 | A | | 12/1997 | Franchino et al. | |

FOREIGN PATENT DOCUMENTS

| | | |
|---|---|---|
| CH | 26 016 A | 4/1902 |
| GB | 2 237 622 A | 5/1991 |

* cited by examiner

*Primary Examiner*—Charles T. Jordan
*Assistant Examiner*—Jordan Lofdahl
(74) *Attorney, Agent, or Firm*—Oliff & Berridge PLC

(57) ABSTRACT

A guide system for the recoiling mass of a gun relative to its cradle, the recoiling mass being equipped with a carrier that slides relative to sliders attached to two lateral slides. The carrier is provided with a rail incorporating a groove in which a slider is disposed. Each groove has a shape preventing the slider received therein from being extracted from it. Each slider is attached to a support. The combination of carriers and sliders is adjustable relative to the slides, by the supports, to compensate for wear.

20 Claims, 6 Drawing Sheets

GUIDE SYSTEM FOR THE RECOILING MASS OF A GUN

BACKGROUND OF THE INVENTION

1. Field of Invention

The technical domain of the invention is that of guide systems for a recoiling mass of a gun relative to its cradle.

2. Description of Related Art

It is known that when guns are fired they recoil relative to the cradle on which they are mounted. This mounting arrangement is found in a trunnion-mounted gun or in a field gun. The recoiling mass is composed of the gun plus the breech ring. This mass is slidably mounted relative to the cradle and braked by hydraulic brakes for example. In this case, the cradle has two slides and the recoiling mass is attached to a carrier equipped with sliders that slide relative to the slides. Systems are known wherein the carrier/slide link is provided by a carrier's slider fastened to the cradle's slide with a pin for sliding in a groove of the carrier. In this configuration, the lateral play between the carrier and the two slides of the cradle is uncontrolled and, moreover, increases with wear.

The goal of the invention is to remedy this drawback by proposing a new guide system for a recoiling mass relative to slides for eliminating and zeroing the lateral play between the slides and the carrier.

SUMMARY OF THE INVENTION

The invention relates to a guide system for the recoiling mass of a gun relative to its cradle, the recoiling mass being equipped with a carrier that slides relative to sliders attached to two lateral slides, characterized in that the carrier is provided with a rail incorporating a groove in which the slider is disposed. The groove is provided with a shape preventing the slider from being extracted from it. Each slider is attached to a support fastened to each slide.

According to a first feature, the slider has two pairs of faces, each pair forming a V such that the two V's are opposite each other and are slidably received in the groove. Thus, the groove has a shape matching the shape of the slider but inverted thereto such that the grooves, having two pairs of matching faces each form an inverted V with the two V's being opposite each other for receiving the respective sliders.

Advantageously, the gap separating the slider and the slide is adjustable and the support of the slider is screwed to the slide by a nut screwed onto the support and held by a lock washer enabling the play between the slider and the slide to be adjusted by screwing.

Preferably, the slider is made of bronze, is substantially parallelepipedic in shape and has a rear bevel to facilitate placement of the recoiling mass on the slides.

According to another feature, the slider has a substantially rectangular orifice and a counterbore also rectangular in shape. The orifice and the counterbore having the same widths and the centers of their lengths being the same.

According to another feature, the support has a cylindrical shaft provided with a threaded design to receive a nut and a notch designed to lock the washer rotationally.

Advantageously, the support has two cylindrical faces tangentially truncated by two flats, designed to fit on the inside of the counterbore and the orifice.

According to another feature, the slide has a bore designed to receive the cylindrical shaft of the support and a longitudinal groove disposed opposite the flats of the cylindrical face of the support providing play between the flats and the slide.

Advantageously, the support can oscillate around the shaft relative to the slide, the fit between the bore of the slide and the shaft of the slider support being a sliding fit.

An advantage of the invention is that the lateral positioning of the carrier relative to the slides is entirely under control. As a result, the recoiling mass returns exactly to the firing position with each shot.

Another advantage is that the system adjusts for the play introduced by wear.

Another advantage is the absence of deformation by spreading of the slides.

Another advantage is that the wear on the sliders is uniform.

Another advantage is that the system allows the carrier to deform during firing.

Other features, details, and advantages of the invention will emerge more clearly from reading the description of the embodiments hereinbelow with reference to the drawings.

DETAILED DESCRIPTION OF PREFERRED EMBODIMENTS

Figure 1:
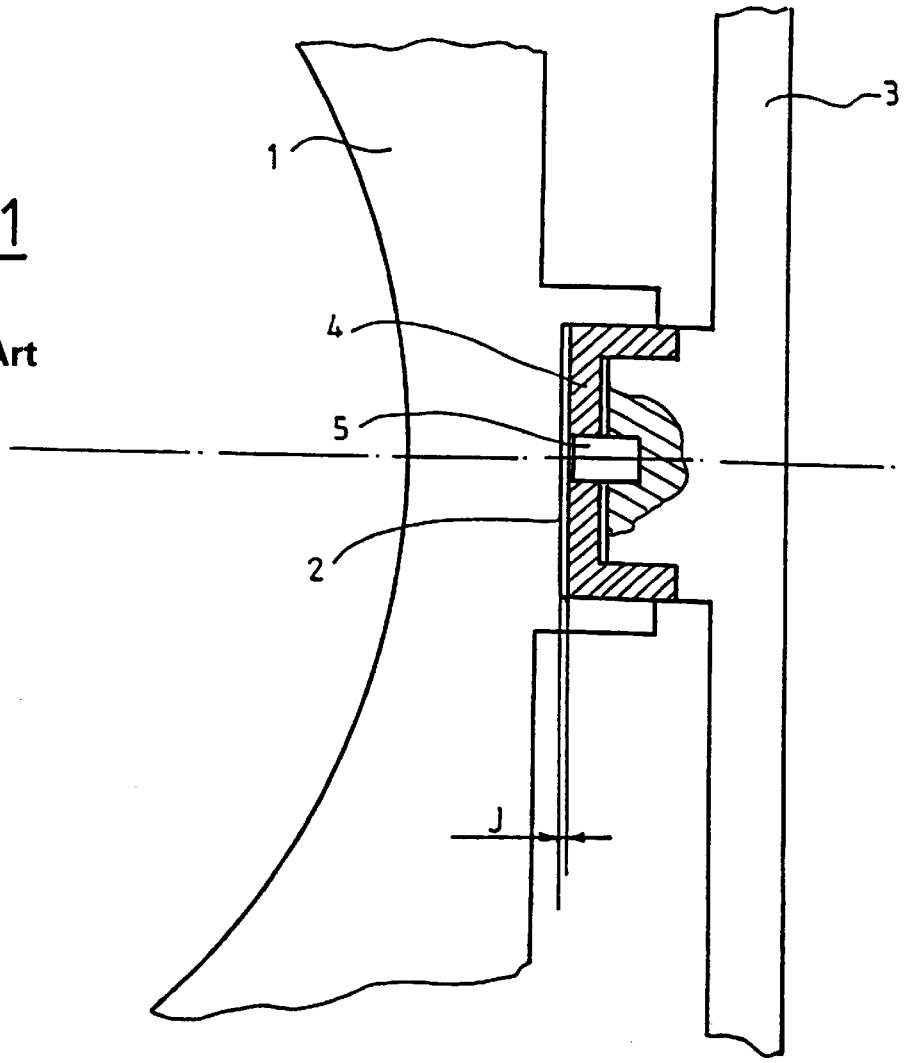
FIG.1 Related Art
FIG. 1 is a section showing the slide/carrier connection in a known design.

As stated above, the recoiling mass of a gun has an oscillating movement relative to the cradle. FIG. 1 shows part of a classic design in which a carrier 1 is designed to receive the gun barrel (not shown). The carrier 1 is provided with a groove 2 which receives a slider 4 fastened to slide 3 by a pin 5. In this configuration, the inevitable wear of the slider changes the amount of play J permanently between slider 4 and groove 2, as it is not possible to adjust independently the distance between slider 4 and groove 2. As a result, the positioning of the recoiling mass relative to the cradle becomes inaccurate.

Figure 2:
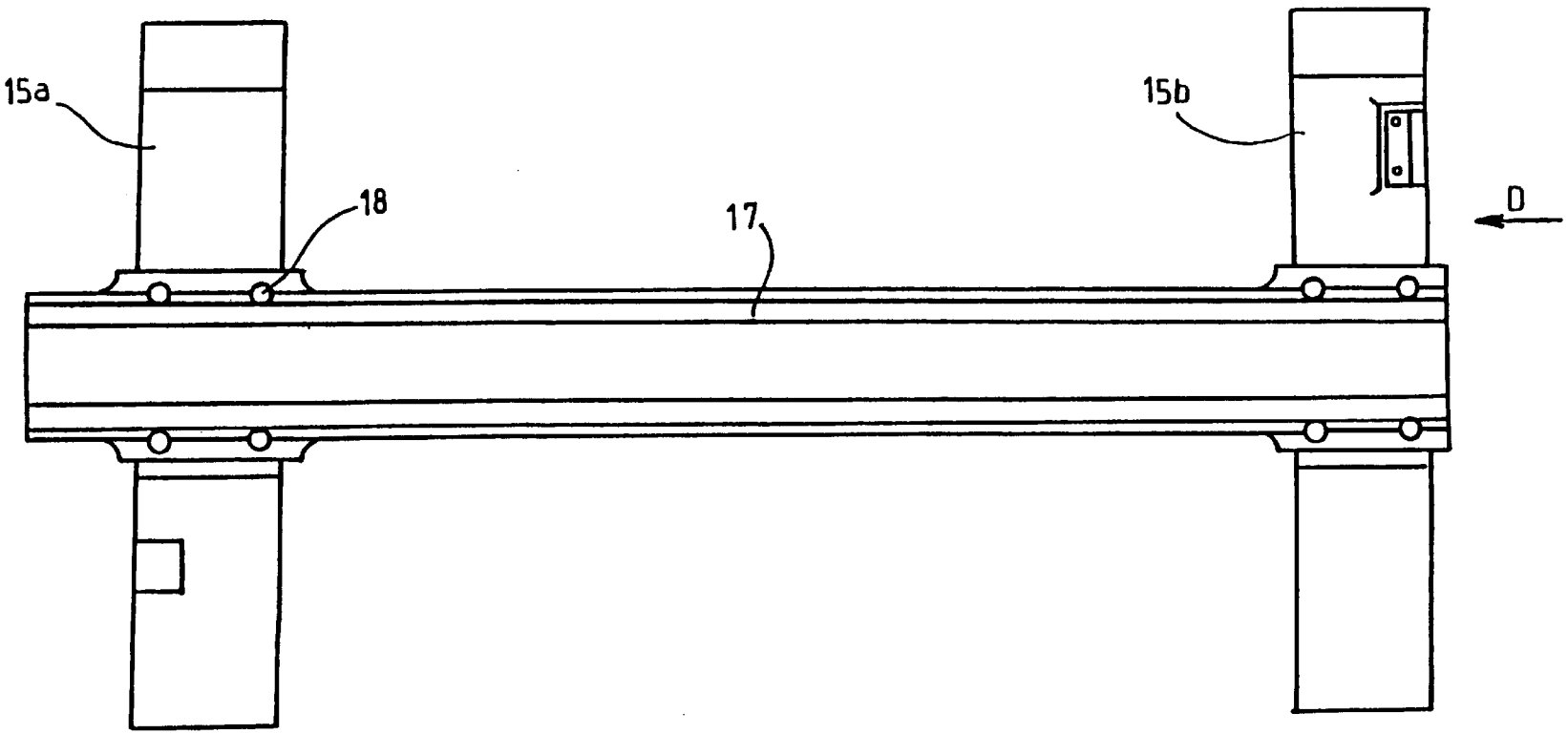
FIG. 2 is a side view of the carrier according to the invention.

FIG. 2 is a side view of the mounting arrangement of carrier 15 of the claimed invention. The carrier 15 is made of a front part 15*a* and a rear part 15*b* that are connected by rails 17. The gun barrel is not shown.

Figure 3:
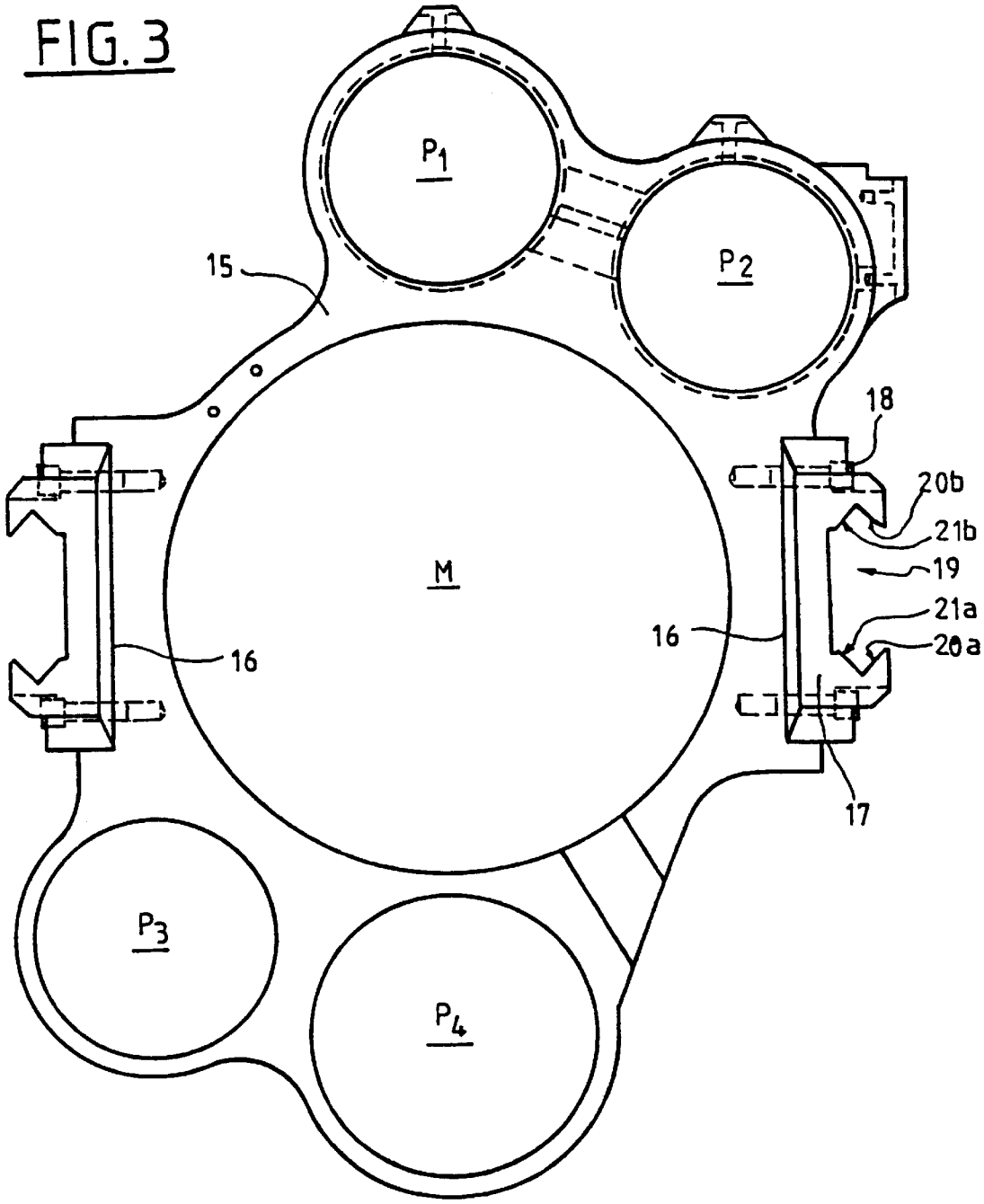
FIG. 3 is a view in direction D of FIG. 2 showing a carrier equipped with the system according to the invention.

FIG. 3 shows, for illustration of the invention, a view of the carrier 15 surrounding the gun barrel M (not shown) wherein the carrier 15 is provided with passageways P1–P4 designed to receive the hydraulic brakes of the recoiling mass. The carrier 15 is provided with two symmetrical notches 16 in which a rail 17 is held by screw 18. Each rail 17 is provided with a groove 19 that has a guiding shape having two Vs. The groove 19, in which the slider is introduced, traps and prevents the slider from being extracted therefrom. In radial section, groove 19 has two pairs of faces (20*a,* 21*a*) and (20*b,* 21*b*) each forming a V, with the two V's being opposite to and facing each other. Of course, any equivalent shape could be used, when the system according to the invention is reduced to practice, provided it traps the slider.

Figure 4:
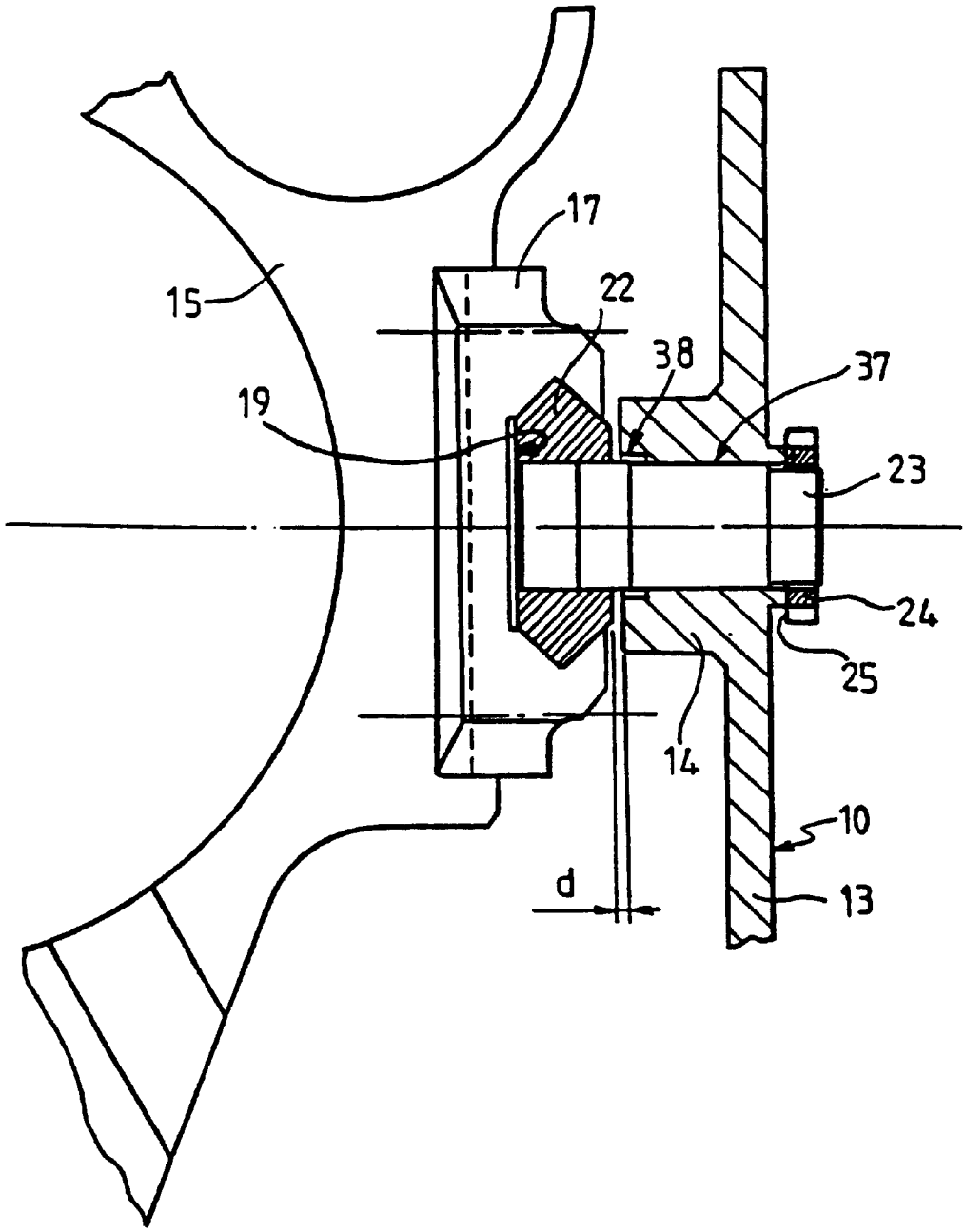
FIG. 4 is a partial cross section showing the carrier/slide link.

FIG. 4 is a partial cross section of the mounting arrangement of the carrier 15 relative to its slide 10. Each slide supports a slider 22 attached thereto by a support 23 that is attached to the solid part 14 of the slide by means of a nut 24 screwed onto support 23 and held by a lock washer 25. Each slider 22 is preferably made of bronze.

Figure 5:
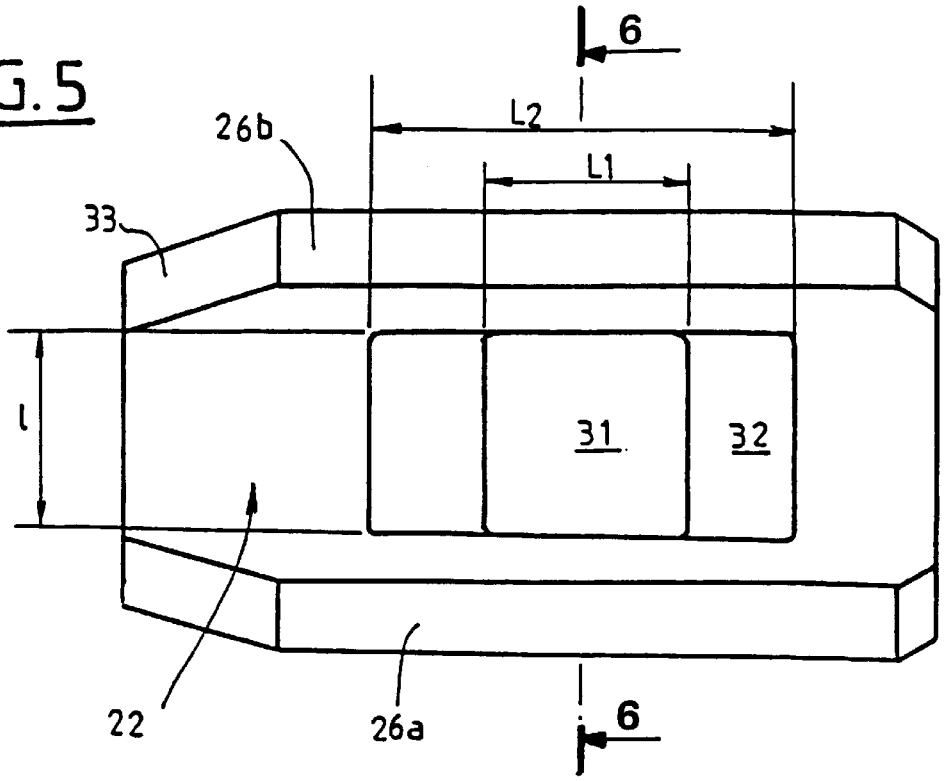
FIG. 5 is a side view of a slider.
Figure 6:
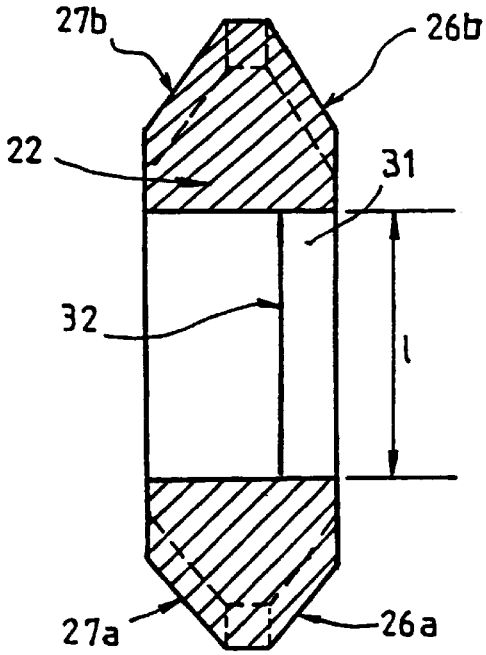
FIG. 6 is a section through a slider along line 6—6 in FIG. 5.

FIGS. 5 and 6 show slider 22, whose shape is substantially parallelepipedic, having two pairs of faces (26*a,* 27*a*) and (26*b,* 27*b*) each forming a V, with the two Vs being opposite each other. Faces (26*a,* 27*a*) and (26*b,* 27*b*) complementarily match the shapes of faces (20*a,* 21*a*) and (20*b,* 21*b*) of groove 19 of each rail 17. Thus, when slider 22 is introduced into groove 19 on either rail 17, the slider is trapped therein and cannot be extracted laterally therefrom. The slider also has a substantially rectangular orifice 31 and a similarly shaped counterbore 32, the orifice and counterbore having the same widths and the centers of their lengths being the same. Slider 22 also has a rear bevel 33 designed to facilitate mounting of the recoiling mass on slides 10.

Figure 8:
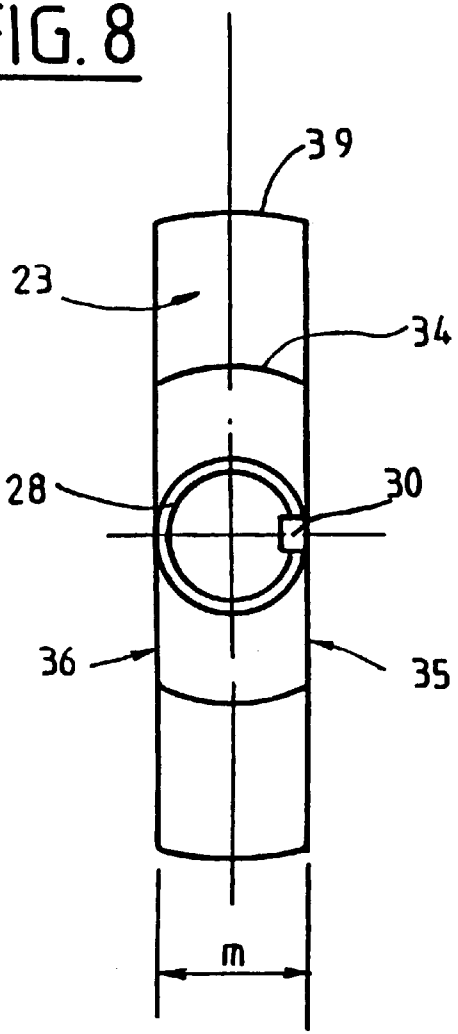
FIG. 8 is a view of the slider support in direction E in FIG. 7.
Figure 7:
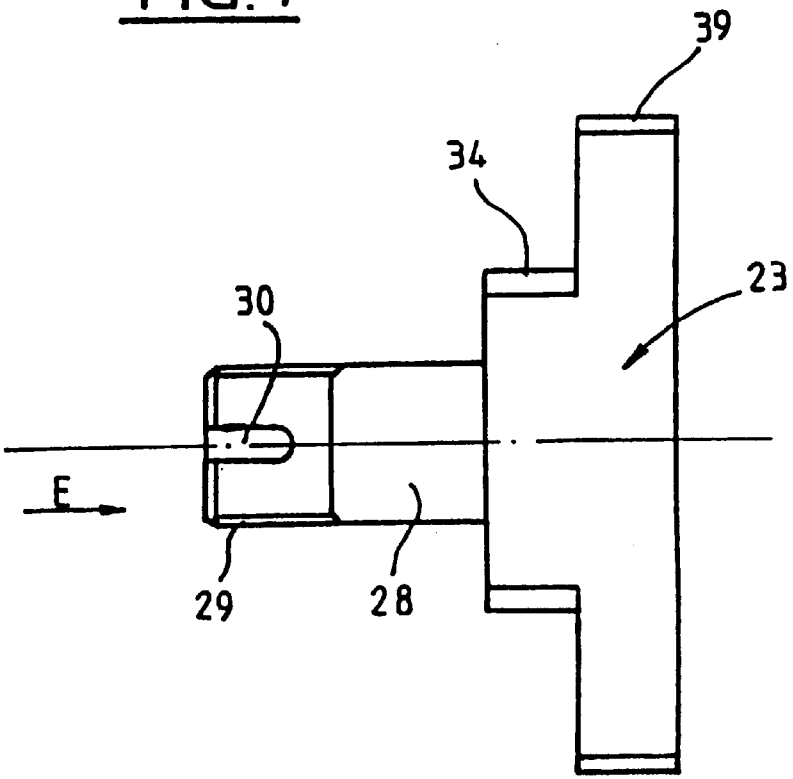
FIG. 7 is a side view of a slider support.

FIGS. 7 and 8 show support 23 of slider 22. It has a cylindrical shaft 28 provided with a thread 29 designed to receive nut 24 and a notch 30 designed to prevent washer 25 from rotating. Support 23 has two cylindrical faces 39 and 34 tangentially truncated by two flats 35, 36. These two truncated faces 39 and 34 are designed to cooperate by fitting respectively against the interior of counterbore 32 and of orifice 31, as shown in FIG. 4. For this purpose, the width m between the two flats 35, 36 is substantially equal to the common length 1 of orifice 31 and counterbore 32, the diameter of face 39 is substantially equal to length L2 of counterbore 32, and the diameter of face 34 is substantially equal to the length L1 of orifice 31 wherein the dimensions are depicted in FIGS. 5 and 8.

With reference to FIG. 4, it can be seen that when slider 22 is attached to support 23 and nut 24 is tightened, carrier 15 approaches slide 10. This leaves distance (d) between the slider and the slide, which is advantageously identical for the two slides and permits adjustment thereof FIGS. 3–6 show a slider 22 having faces matching the shape of the faces of groove 19, namely complementary V and inverted V shapes in cross section. Sliding of slider 22 in groove 19 of rail 17 then occurs with no lateral play of the carrier 15 relative to the slide 10 so that correct re-setting of the gun to the firing position occurs consistently.

It will be seen that the structure according to the invention does not allow the slides 10 to spread apart.

Any increased play J occurring due to the wearing of a slider 22 as it rubs against groove 19 may be compensated for by retightening nut 24 symmetrically relative to the slides 10 and/or to the carrier 15. The distance (d) between the sliders and slides also compensates for this wear.

FIG. 4 shows that slide 10 has a bore 37 designed to receive the cylindrical shaft 28 of support 23 of the slider and also a lengthwise groove 38 disposed opposite flats 35, 36 of cylindrical face 34 of support 23 and providing play between the flats 35, 36 and the slide 10. Since the fit between bore 37 of the slide 10 and shaft 28 of the slider support 23 is a sliding fit, when the recoiling mass recoils and returns to the firing position when firing a round, slider 22 and support 23 can oscillate around shaft 28 relative to slide 10. This compensates for the deformation of the carrier brought about by the reverse rotational torque during firing and also facilitates the joining of the recoiling mass and the slides. This oscillation of the sliders 22 also guarantees substantially uniform wear of the sliders 22 over their entire length. Grooves 19 of the carrier 15 guide the slider's 22 recoil, conferring on the latter optimum angular positioning of the slider 22 relative to the slide 10. This compensates for deformations of the carrier by distributing the wear over the entire length of the sliders on each occasion. As a result, the guide system has a longer service life.

Deformation of the carrier is limited by lengthwise groove 38 whose flanks serve as stops for flats 35, 36 of face 34 of support 23 by limiting the angle of rotation of the slider support 23 relative to slide 10.

What is claimed is:

1. A guide system for the recoiling mass of a gun relative to its cradle comprising: a pair of lateral slides for the gun; a slidable carrier, attached to the two lateral slides, in which a slider is disposed, the slidable carrier comprising at least one rail incorporating a groove, the groove having a shape preventing the slider from being extracted from it, each slider being attached to a support fastened to each slide.

2. The guide system according to claim 1, wherein each slider comprises two pairs of faces each pair forming a V, with the two V's being opposite each other.

3. The guide system according to claim 2, wherein each groove has a shape invertedly matching the shape of the slider faces such that each groove has two pairs of matching faces each pair forming an inverted V relative to the slider faces with the two inverted Vs being opposite each other.

4. The guide system according to claims 1, wherein a distance separating the slider and slide is adjustable.

5. The guide system according to claims 2, wherein a distance separating the slider and slide is adjustable.

6. The guide system according to claims 3, wherein a distance separating the slider and slide is adjustable.

7. The guide system according to claim 4, wherein the support of the slider is fixed to the slide by a nut screwed onto the support and held by a lock washer enabling the distance between the slider and the slide to be adjusted by screwing.

8. The guide system according to claim 5, wherein the support of the slider is fixed to the slide by a nut screwed onto the support and held by a lock washer enabling the distance between the slider and the slide to be adjusted by screwing.

9. The guide system according to claim 6, wherein the support of the slider is fixed to the slide by a nut screwed onto the support and held by a lock washer enabling the distance between the slider and the slide to be adjusted by screwing.

10. A guide system according to claim 1, wherein the slider is made of bronze.

11. The guide system according to claim 1, characterized in that the slider is substantially parallelepipedic in shape and has a rear bevel designed to facilitate placement of the recoiling mass on the slides.

12. The guide system according to claim 1, further comprising the slider having a substantially rectangular orifice and a counterbore also rectangular in shape, the orifice and the counterbore having the same width and the centers of their lengths being the same.

13. The guide system according to claim 7, further comprising the support having a cylindrical shaft provided with a threaded design to receive a nut and further having a notch designed to lock a washer rotationally.

14. The guide system according to claim 8, further comprising the support having a cylindrical shaft provided with a threaded design to receive a nut and further having a notch designed to lock a washer rotationally.

15. The guide system according to claim 9, further comprising the support having a cylindrical shaft provided with a threaded design to receive a nut and further having a notch designed to lock a washer rotationally.

16. The guide system according to claim 12, further comprising the support having a cylindrical shaft provided with a threaded design to receive a nut and further having a notch designed to lock a washer rotationally.

17. The guide system according to claim 7, wherein the support has two cylindrical faces tangentially truncated by two flats and designed to cooperate by fitting on the inside of counterbore and orifice, respectively.

18. The guide system according to claim 16, wherein the support has two cylindrical faces tangentially truncated by two flats and designed to cooperate by fitting on the inside of counterbore and orifice, respectively.

19. The guide system according to claim 18, wherein each slide has a bore designed to receive a cylindrical shaft of the support and a longitudinal groove disposed opposite the flats of the cylindrical face of the support providing play between the flats and the slide.

20. The guide system according to claim 19, wherein the support can oscillate around the shaft relative to the slide, and the fit between bore of the slide and the shaft of the slider support is a sliding fit.

* * * * *